US005112021A

United States Patent [19]

Greene

[11] Patent Number: 5,112,021

[45] Date of Patent: May 12, 1992

[54] BOOKHOLDER

[76] Inventor: Philip D. Greene, 336 Ridgewood Ave., Mill Valley, Calif. 94941

[21] Appl. No.: 609,585

[22] Filed: Nov. 6, 1990

[51] Int. Cl.[5] ..... A47B 97/00

[52] U.S. Cl. ..... 248/444.1; 248/445; 248/447.1; 248/448

[58] Field of Search ..... 248/460, 444.1, 445, 248/448, 447.1; 9/507

[56] References Cited

U.S. PATENT DOCUMENTS

| | | | |
|---|---|---|---|
| 1,083,764 | 1/1914 | Smith | 248/445 |
| 1,699,853 | 1/1929 | Moran | 248/445 |
| 2,448,734 | 9/1948 | Phillips | 248/445 |
| 2,638,701 | 5/1953 | Dahlgren | 248/445 |
| 3,905,573 | 9/1975 | Davis | 248/445 |
| 4,140,296 | 2/1979 | Guillen | 248/445 |

FOREIGN PATENT DOCUMENTS

| | | | |
|---|---|---|---|
| 880794 | 6/1953 | Fed. Rep. of Germany | 248/445 |
| 1023440 | 3/1953 | France | 248/445 |
| 526258 | 5/1955 | Italy | 5/507 |

*Primary Examiner*—David L. Talbott
*Attorney, Agent, or Firm*—Larry D. Johnson

[57] ABSTRACT

A bookholder device includes a main arm portion for hinged attachment to a wall (or alternatively, for free standing support on the floor). A clutch assembly portion is attached to the main arm, and releasably engages a rod member. A tray bracket is pivotally connected to the rod member, and further pivotally supports a book tray portion. This book tray supports the book in question by a combination of contact by a tray base, tray perimeter flanges, and a height-adjustable tray cross-member.

8 Claims, 9 Drawing Sheets

BOOKHOLDER

BACKGROUND OF THE INVENTION

1. Field of the Invention

This invention relates generally to supports, stands and related structures for holding books, and more specifically to an improved bookholder device enabling essentially infinite adjustment of the position and orientation of a book in front of a reclining reader.

2. Description of the Prior Art

Book stands and supports are well known. Most such devices require complex and cumbersome actions to adjust the book to a comfortable reading position, and thereafter to turn the pages of the book. In addition, most devices require that reading be done through transparent plastic or glass, which may reduce reading comfort.

SUMMARY OF THE INVENTION

The bookholder device of this invention provides a structure for supporting a book in front of a reclined individual, while enabling essentially infinite adjustment of the position and orientation of the book, and without requiring viewing of the book through a transparent surface. The device includes a main arm portion for hinged attachment to a wall (or alternatively, for free standing support on the floor). A clutch assembly portion is attached to the main arm, and releasably engages a rod member. A tray bracket is pivotally connected to the rod member, and further pivotally supports a book tray portion. This book tray supports the book in question by a combination of contact by a tray base, tray perimeter flanges, and a height-adjustable tray cross-member, the latter two components (at least) being preferably made of an optically transparent material so as not to obscure any portion of the printed page of the book.

Book position and orientation is determined by one or more of several adjustments that can be made with minimal effort by the user:

1. Main arm yaw adjustment accomplished by movement about either the wall hinge or free standing support base;

2. Rod member longitudinal adjustment accomplished via loosening of the clutch assembly, extension or retraction of the rod member within the clutch assembly, and retightening of the clutch assembly;

3. Rod member pitch adjustment accomplished via loosening of the clutch assembly, pivoting of the rod member about its lateral axis defined by the clutch assembly, and retightening of the clutch assembly;

4. Rod member roll adjustment accomplished via loosening of the clutch assembly, turning movement of the rod member about its longitudinal axis within the clutch assembly, and retightening of the clutch assembly;

5. Book tray portion pitch adjustment accomplished via movement of the book tray about the bracket/tray pivot; and 6. Book tray portion yaw adjustment accomplished via movement of the tray bracket member about the rod/bracket pivot.

Figure 10:
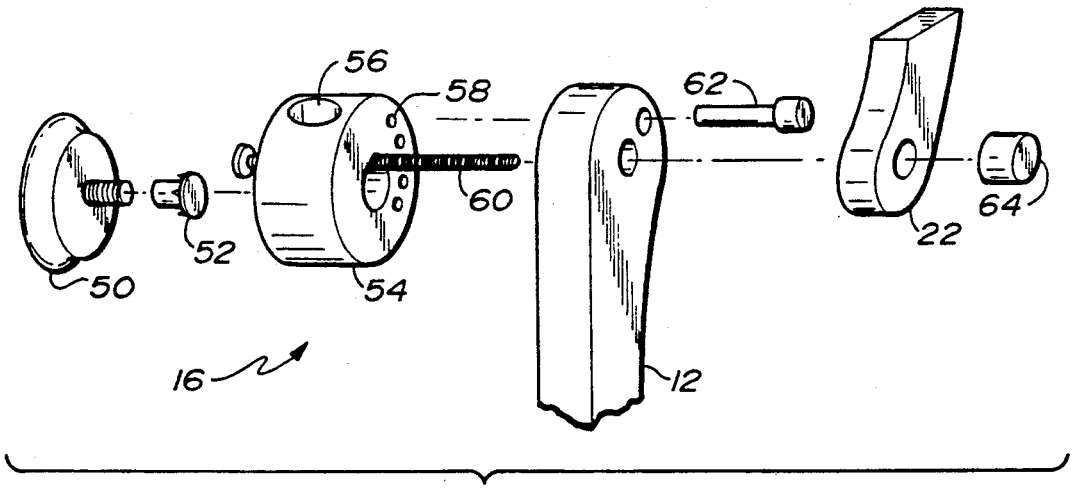
Figure 11:
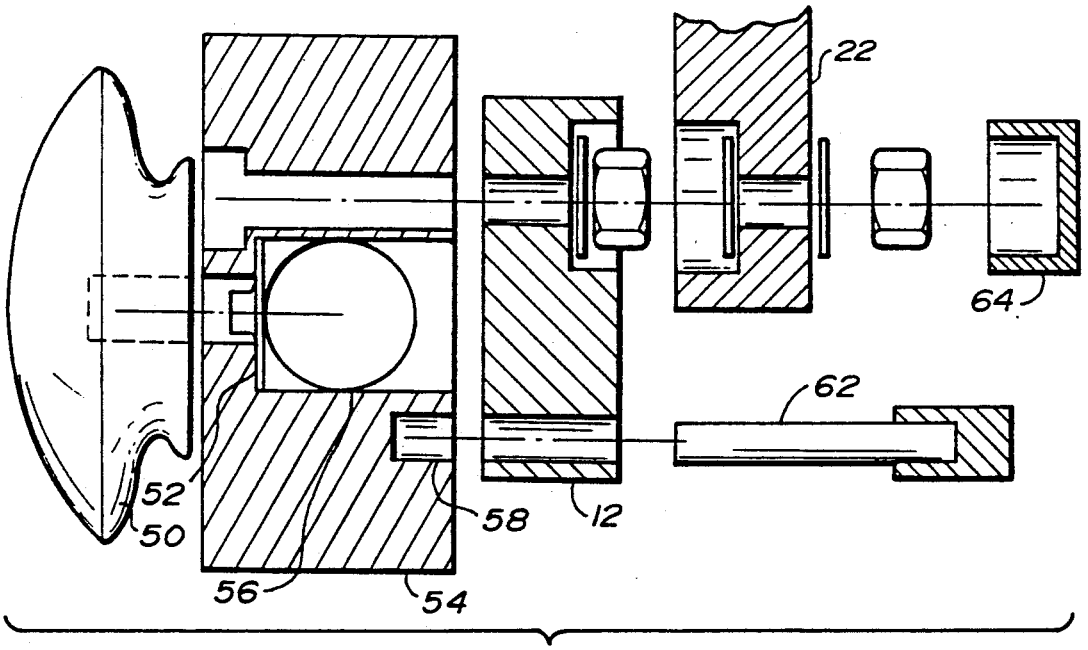

FIGS. *7a–7f* are a series of side elevation views of the rod member, clutch assembly portion, tray bracket member, and book tray portion of the bookholder of this invention, illustrating several of the book orientations possible with the device;

FIGS. *8a–8g* are a series of front elevation views (from the perspective of the reader) of the book tray portion of the bookholder device of this invention, illustrating several of the book orientations that are possible with the device;

FIGS. *9a–9e* are a series of front elevation views (also from the perspective of the reader) of the book tray portion of the bookholder device of this invention, illustrating several book sizes and their relative positions within the book tray portion possible with the device;

FIG. 10 is an exploded perspective view of the clutch assembly portion of the bookholder device of this invention; and FIG. 11 is an exploded cross-sectional view of the clutch assembly portion of the bookholder device of this invention.

DETAILED DESCRIPTION OF A PREFERRED EMBODIMENT

Figure 1:
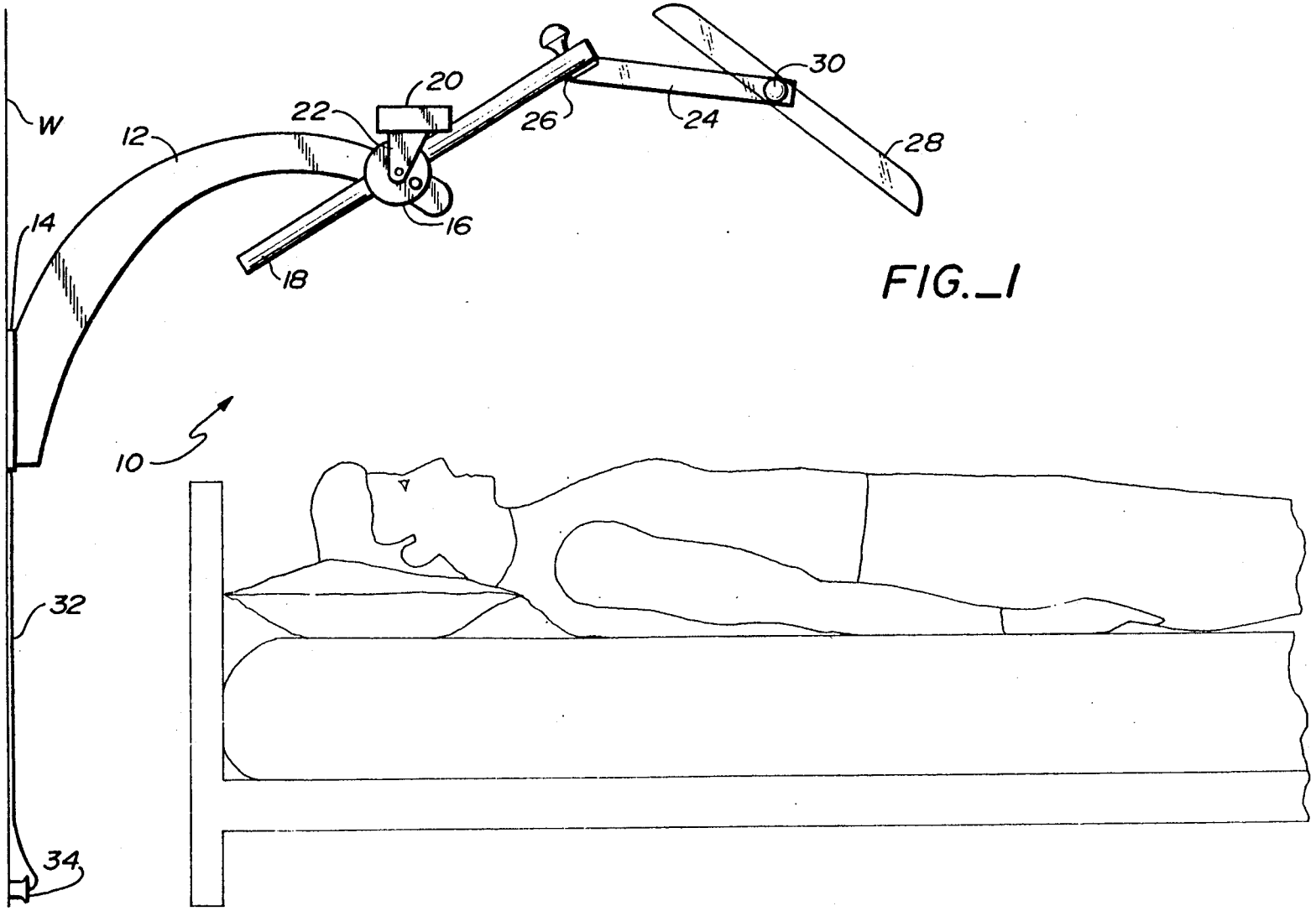
FIG. 1 is a side elevation pictorial view of a bookholder device of this invention in use to position and hold a book in front of a reclined individual for reading.

FIG. 1 is a side elevation pictorial view of a bookholder device 10 of this invention in use to position and hold a book in front of a reclined individual I for reading. This view illustrates the entire apparatus, including main arm 12 attached to a wall W by hinge 14, clutch assembly portion 16 connected to main arm 12 near its terminus, rod member 18 movably engaged by clutch assembly portion 16, reading light 20 movably connected to the clutch assembly portion by light arm 22, tray bracket member 24 attached to rod member 18 at rod/bracket pivot 26, and book tray portion 28 attached to tray bracket member 24 at bracket/tray pivot 30. The particular arrangement of these components enables essentially infinite adjustment of the position and orientation of a book held in book tray portion 28. For example, hinge 14 enables yaw adjustment of main arm 12 in approximately 180 degrees of arc. Clutch assembly portion 16 enables three types of adjustment of rod member 18 relative to the reader:

1. Longitudinal adjustment (extension or retraction) of the rod member within the clutch assembly portion, thereby affecting the distance of the book to the individual;

2. Roll adjustment of the rod member about its longitudinal axis, thereby affecting the angle of the book to the individual; and 3. Pitch adjustment of the rod member about its lateral axis, thereby affecting the height of the book to the individual.

In addition, rod/bracket pivot 26 enables yaw adjustment of the tray bracket and book tray portion relative to the rod member, thereby further affecting the angle of the book to the individual. Finally, bracket/tray pivot 30 enables pitch adjustment of the book tray portion relative to the bracket member, further affecting the angle of the book to the individual.

Reading light 20 provides a controlled field of light to properly illuminate the reading material held by the book tray portion. Reading light 20 may be powered by batteries, or, in the preferred embodiment, is powered by a low-voltage circuit (e.g., twelve volts D.C.) via cord 32 and transformer/plug 34.

Figure 2:
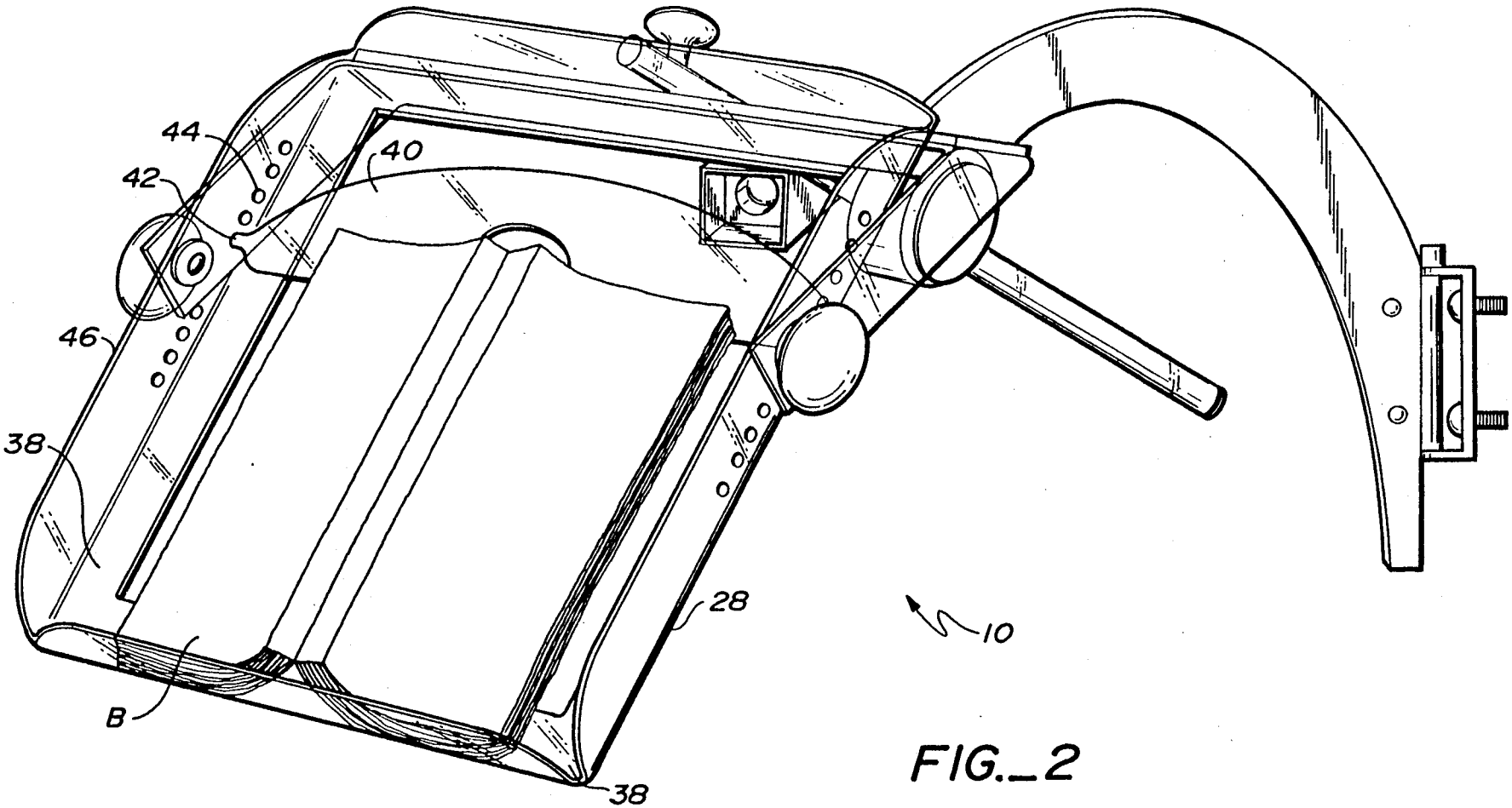
FIG. 2 is a rear perspective view of a bookholder device of this invention.

FIG. 2 is a rear perspective view of a bookholder device 10 of this invention. Book tray portion 28 supports an open book B on some combination of its base 36, tray perimeter flanges 38, and height-adjustable tray crossmember 40. The tray crossmember may include pins 42 engageable in holes 44 carried in sides 46 of the tray portion. Flanges 38 and crossmember 40 are preferably made of optically transparent material such as plastic or glass, so as not to obscure any portion of text of the book.

Figure 3:
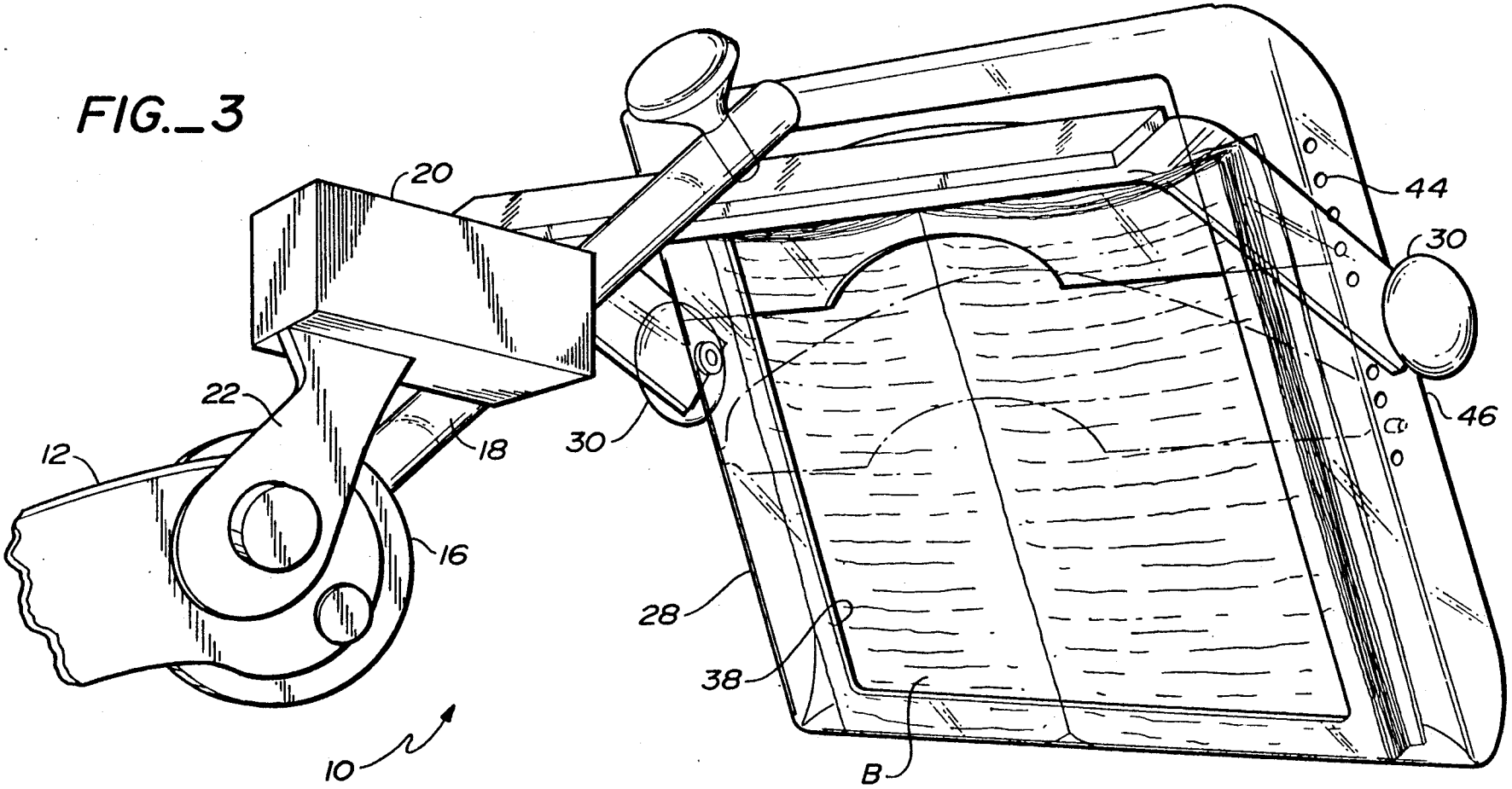
FIG. 3 is a partially cutaway front perspective view of a bookholder device of this invention.

FIG. 3 is a partially cutaway front perspective view of a bookholder device 10 of this invention. This view illustrates the capture and support of the book B from the perspective of the reader, and the alignment of reading light 20 on the front surface of the opened book.

Figure 4:
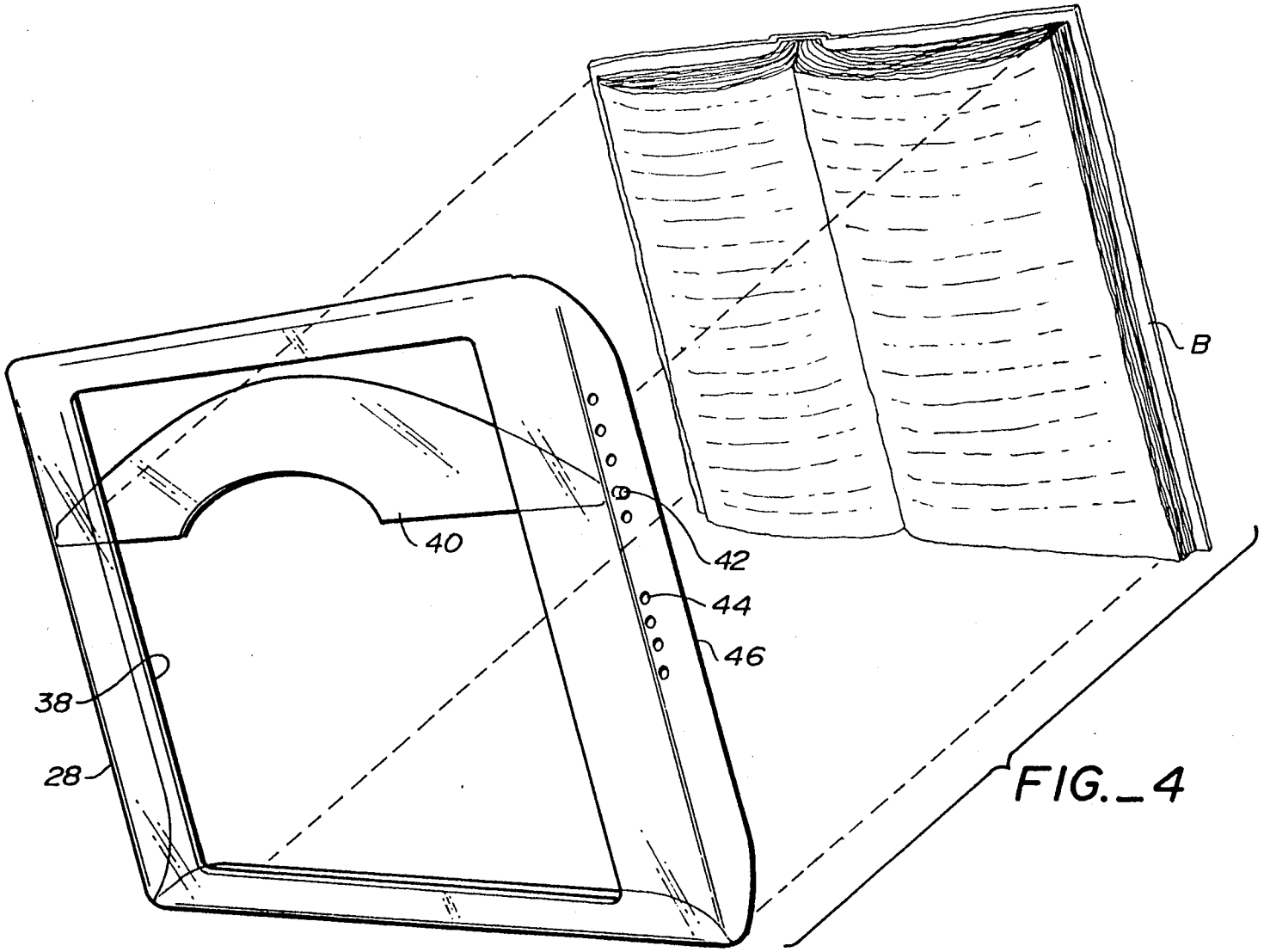
FIG. 4 is a front perspective view of the book tray portion of the bookholder device of this invention, illustrating the placement of a book into the tray portion for retention.

FIG. 4 is a front perspective view of the book tray portion 28 of the bookholder device of this invention, illustrating the placement of a book B into the tray portion for retention. This view also suggests the ease of turning pages of the book, by simply lifting the book slightly from the tray portion, turning the page, and replacing the book in the tray portion.

Figure 5:
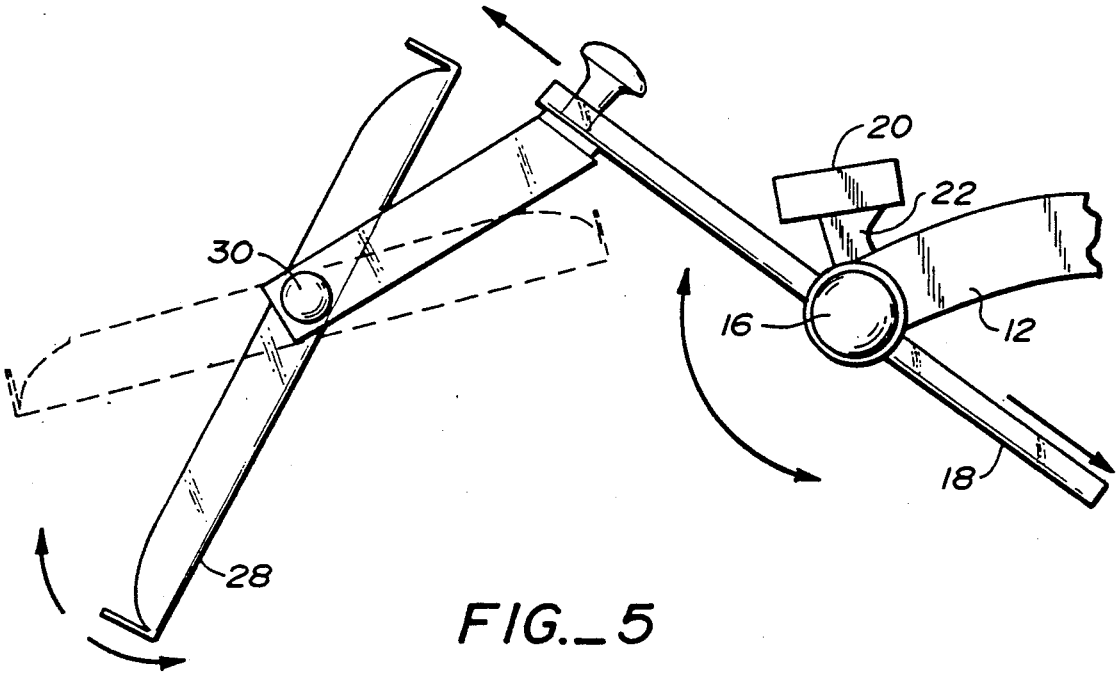
FIG. 5 is a partially cutaway side elevation view of the bookholder device of this invention, illustrating the rod member longitudinal adjustment (extension/retraction), rod member pitch adjustment, and book tray portion pitch adjustment.

FIG. 5 is a partially cutaway side elevation view of the bookholder device of this invention, illustrating the rod member 18 longitudinal adjustment (extension/retraction), rod member 18 pitch adjustment, and book tray portion 28 pitch adjustment. These adjustments, along with main arm yaw adjustment (described supra), and rod member roll adjustment and book tray portion yaw adjustment (described infra) enable essentially infinite adjustment of the position and orientation of the book relative to the reader.

Figure 6:
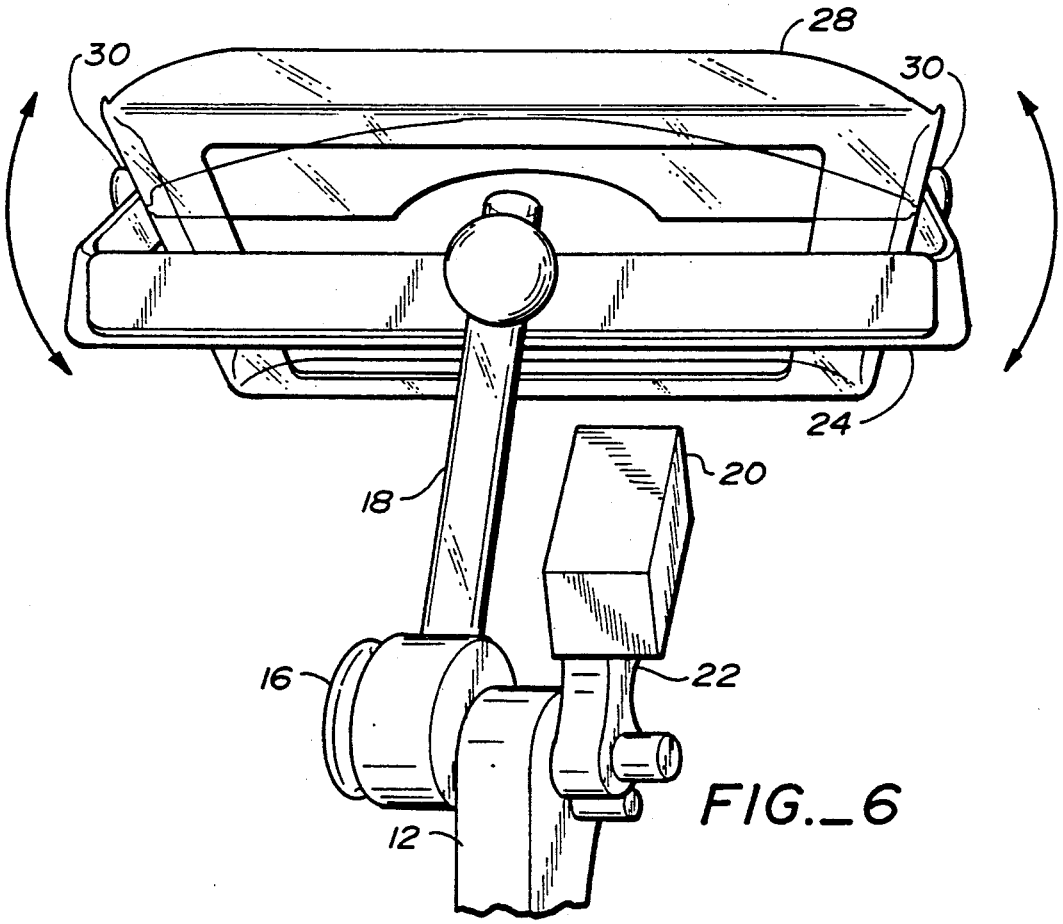
FIG. 6 is a partially cutaway top perspective view of the bookholder device of this invention, illustrating the rod member roll adjustment and book tray portion yaw adjustment.
Figure 7D:
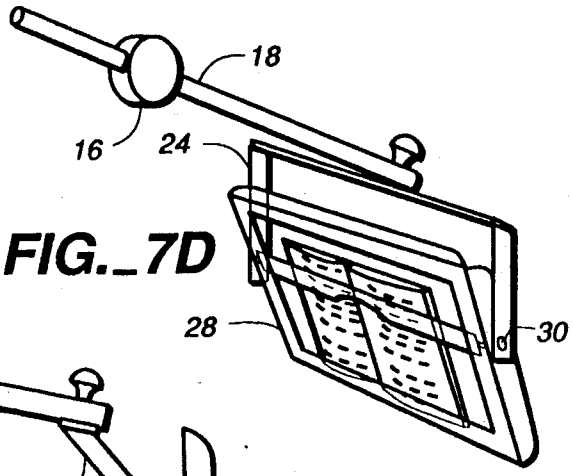
Figure 7E:
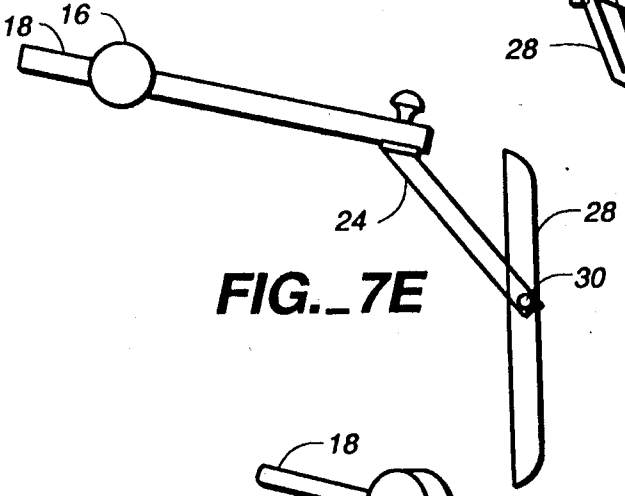
Figure 7F:
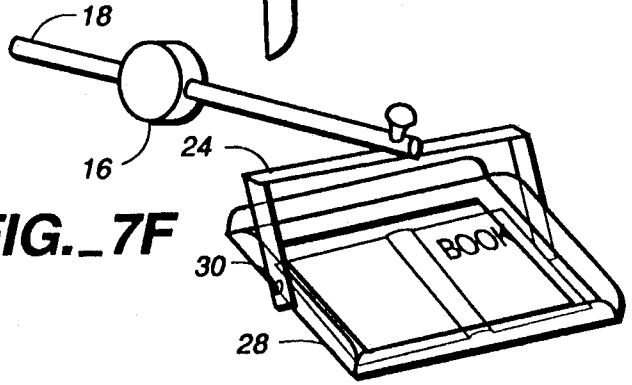
Figure 7A:
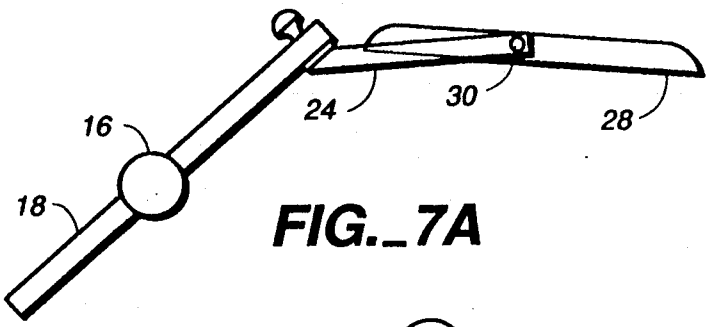
Figure 7B:
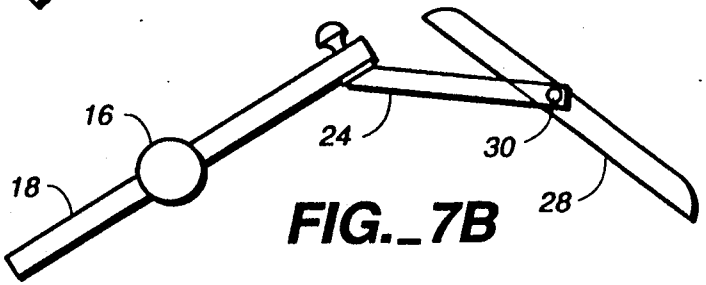
Figure 7C:
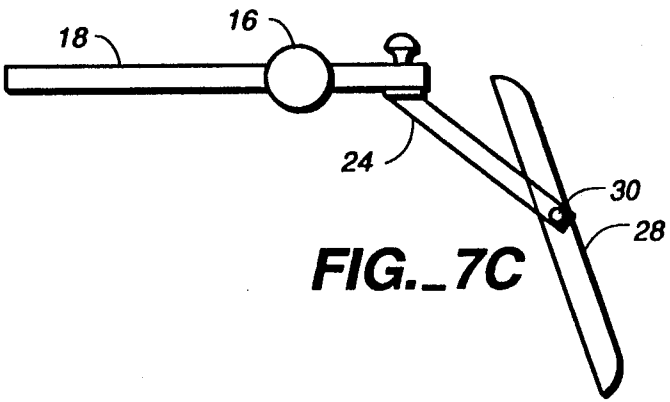
Figure 8F:
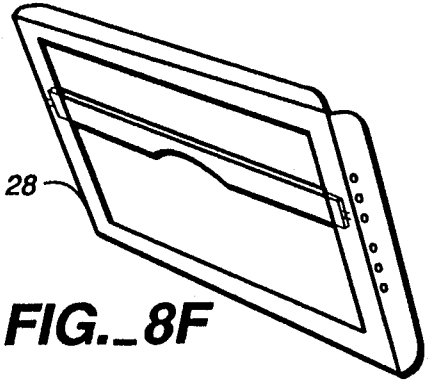
Figure 8G:
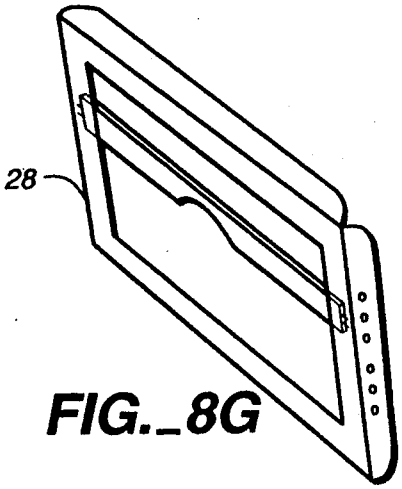
Figure 8C:
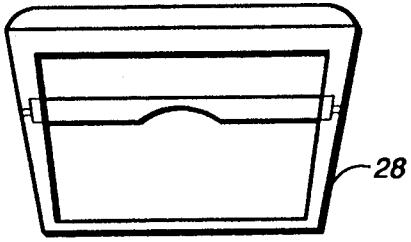
Figure 8D:
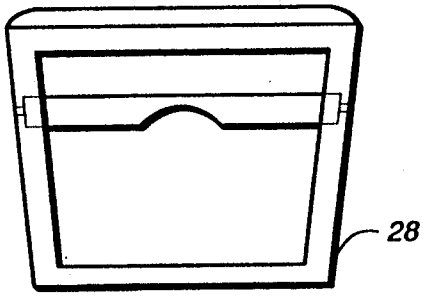
Figure 8E:
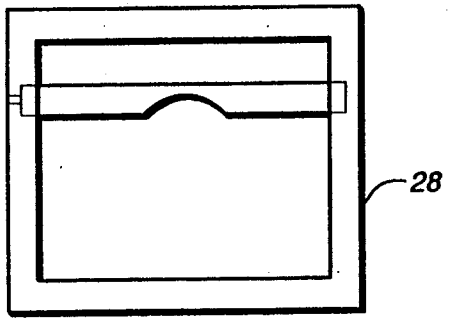
Figure 8A:
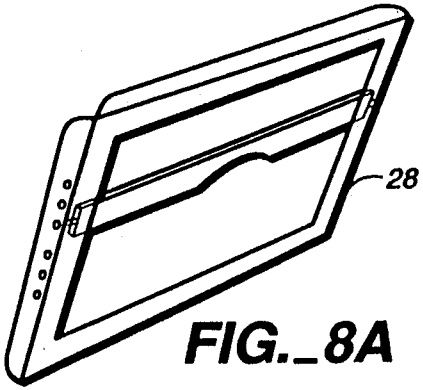
Figure 8B:
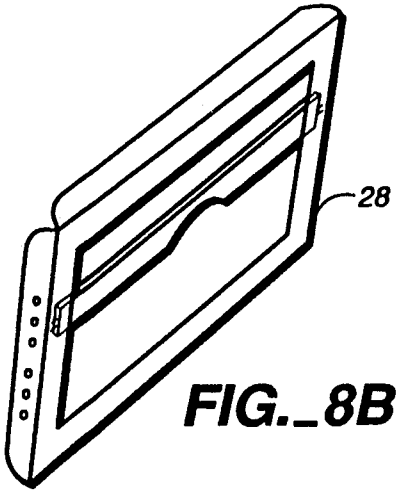
Figure 9B:
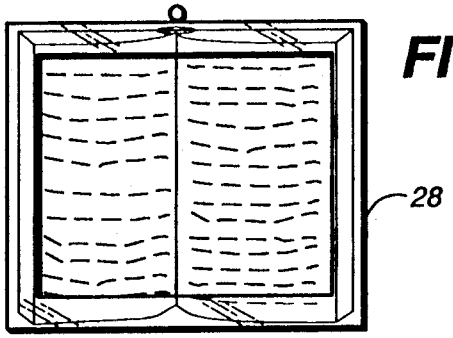
Figure 9C:
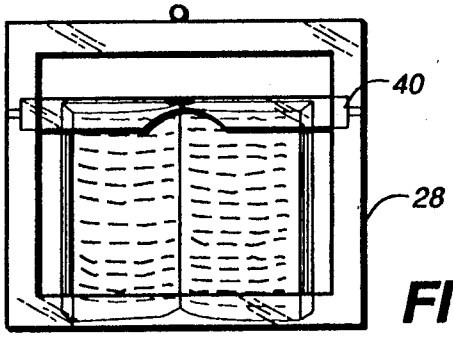
Figure 9D:
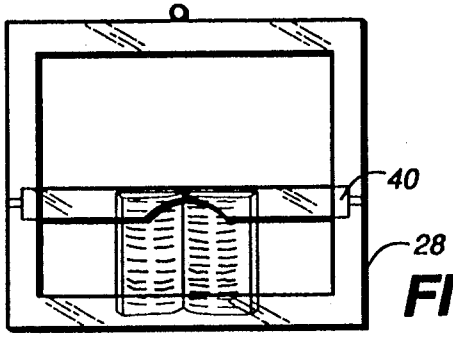
Figure 9E:
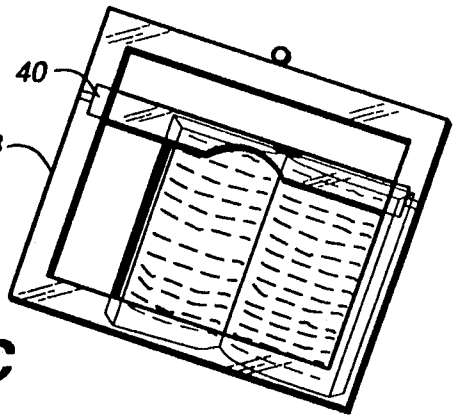
Figure 9A:
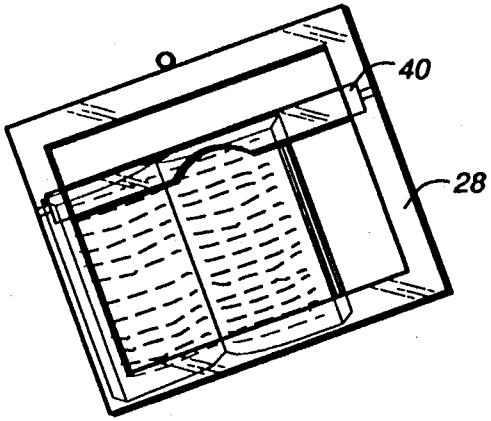

FIG. 6 is a partially cutaway top perspective view of the bookholder device of this invention, illustrating the rod member 18 roll adjustment and book tray portion 28 yaw adjustment. The rod member roll adjustment is effectuated by loosening of the clutch assembly 16 holding rod member 18, while book tray portion yaw adjustment is effectuated by movement of tray bracket member 24 about rod/bracket pivot 26.

FIGS. *7a–7f* are a series of side elevation views of the rod member 18, clutch assembly portion 16, tray bracket member 24, and book tray portion 28 of the bookholder of this invention, illustrating several of the book orientations possible with the device. FIGS. *7a–7c* illustrate a series of vertical and angular adjustments effectuated by rod member pitch adjustment about clutch assembly portion 16, book tray portion pitch adjustment about bracket/tray pivot 30, and longitudinal adjustment of rod member 18 within clutch assembly portion 16. FIGS. *7d–7f* illustrate a series of angular adjustments accomplished by yaw adjustment of the main arm about its hinge (not illustrated), and tray portion pitch adjustment about bracket/tray pivot 30.

FIGS. *8a–8g* are a series of front elevation views (from the perspective of the reader) of the book tray portion 28 of the bookholder device of this invention, illustrating several of the book orientations that are possible with the device. FIGS. *8c–8e* illustrate orientations effectuated purely by book tray portion pitch adjustment, while FIGS. *8a*, *8b*, *8f*, and *8g* illustrate orientations effectuated by a combination of book tray portion pitch adjustment, main arm yaw adjustment, and rod member pitch adjustment.

FIGS. *9a–9e* are a series of front elevation views (also from the perspective of the reader) of the book tray portion 28 of the bookholder device of this invention, illustrating several book sizes and their relative positions within the book tray portion possible with the device. FIGS. *9b–9d* illustrate successively smaller books being captured by the book tray portion 28 by appropriate adjustment of height-adjustable tray crossmember 40. FIGS. *9a* and *9e* illustrate a medium sized book being held at a useful reading angle by appropriate positioning of the book adjacent a respective side of the book tray portion.

FIG. 10 is an exploded perspective view of a clutch assembly portion 16 of the bookholder device of this invention. This assembly may include tightening knob 50, tightening pad 52, clutch block 54 bearing rod bore 56 and a plurality of stop pin holes 58, axle 60, stop pin 62, and axle cap 64. Main arm 12 and light arm 22 are connected to and operate with this assembly, as described infra.

FIG. 11 is an exploded cross-sectional view of the clutch assembly portion 16 (as illustrated in FIG. 10) of the bookholder device of this invention. Rod member longitudinal adjustment and roll adjustment within rod bore 56 of clutch block 54 is accomplished by loosening knob 50 (thereby retracting tightening pad 52 from contact with the rod member), moving the rod member to the desired longitudinal and roll adjustment, and re-tightening knob 50. Alternatively, any other appropriate clamping or other selective-release mechanism could be used. Rod member pitch adjustment is accomplished by retraction of stop pin 62 from stop pin hole 58, movement of the clutch block 54 (bearing the rod member) about axle 60, and inserting stop pin 62 in a different stop pin hole at the desired pitch adjustment. Alternatively, and as above, any other appropriate clamping mechanism could be used.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A bookholder device for supporting a book in front of a reclined individual, said bookholder device comprising:

a main arm portion;

a clutch assembly portion attached to said main arm portion;

a rod member releasably engaged by said clutch assembly portion, said rod member conditioned for pitch, roll, and longitudinal adjustment by said clutch assembly portion;

a tray bracket member connected to said rod member; and a book tray portion pivotally supported by said tray bracket member.

2. The bookholder device of claim 1 wherein said book tray portion includes a tray base and tray perimeter flanges.

3. The bookholder device of claim 2 wherein said book tray portion further includes a tray crossmember.

4. The bookholder device of claim 3 wherein said tray crossmember is adjustable in height within said book tray portion.

5. The bookholder device of claim 4 wherein said tray perimeter flanges and said tray crossmember are made of an optically transparent material.

6. The bookholder device of claim 1 wherein said main arm portion is conditioned for yaw adjustment.

7. The bookholder device of claim 6 wherein said main arm portion includes a hinge member.

8. The bookholder device of claim 1 wherein said tray bracket is pivotally connected to said rod member.

* * * * *